US009127509B2

(12) United States Patent
Robinson et al.

(10) Patent No.: US 9,127,509 B2
(45) Date of Patent: Sep. 8, 2015

(54) POWERED AUGER SUPPORT ASSEMBLY FOR A VEHICLE

(71) Applicants: James Allen Robinson, Nekoosa, WI (US); Dawn Marie Robinson, Nekoosa, WI (US)

(72) Inventors: James Allen Robinson, Nekoosa, WI (US); Dawn Marie Robinson, Nekoosa, WI (US)

( * ) Notice: Subject to any disclaimer, the term of this patent is extended or adjusted under 35 U.S.C. 154(b) by 0 days.

(21) Appl. No.: 13/780,764

(22) Filed: Feb. 28, 2013

(65) Prior Publication Data

US 2013/0233625 A1 Sep. 12, 2013

Related U.S. Application Data

(60) Provisional application No. 61/607,842, filed on Mar. 7, 2012.

(51) Int. Cl.
*F16M 13/00* (2006.01)
*E21B 7/02* (2006.01)

(52) U.S. Cl.
CPC ..... *E21B 7/027* (2013.01)

(58) Field of Classification Search
CPC ..... B60R 9/06; E04H 17/263; E21B 7/028; Y10T 29/4984
See application file for complete search history.

(56) References Cited

U.S. PATENT DOCUMENTS

| | | | | |
|---|---|---|---|---|
| 3,498,483 | A * | 3/1970 | Meharry | 414/523 |
| 5,363,925 | A | 11/1994 | Gallagher | |
| 5,431,121 | A * | 7/1995 | Canepa | 114/141 |
| 5,836,402 | A | 11/1998 | Jones | |
| 6,681,470 | B1 | 1/2004 | Scott | |
| 6,889,779 | B2 * | 5/2005 | Skarlupka et al. | 173/184 |
| 6,921,007 | B1 * | 7/2005 | Guerrant | 224/519 |
| 7,226,058 | B2 | 6/2007 | Bouchard | |
| 7,604,450 | B1 * | 10/2009 | Calvery | 414/462 |
| 7,818,903 | B2 | 10/2010 | Elliot | |
| 7,931,524 | B2 * | 4/2011 | McKenzie | 452/187 |
| 8,210,912 | B2 * | 7/2012 | Ugiansky | 452/187 |
| 8,397,835 | B1 * | 3/2013 | Lyngaas | 175/18 |
| 2010/0308093 | A1 | 12/2010 | Johnson | |

OTHER PUBLICATIONS

The Auger Easer, Sande Specialties, Accessed on: Mar. 5, 2015 http://augereaser.com/index.htm.
Drilling Ice with Ease, HEI UTVS, Publication date: Jan. 12, 2014, Accessed on: Jan. 12, 2014 https://www.youtube.com/watch?v=6ikYYu1Csl8.
Lake Puckaway Ice Auger Caddy for 4-Wheeler, JNB Guide Fishing, Published on: Feb. 22, 2012, Accessed on: Mar. 5, 2015 https://www.youtube.com/watch?v=njEHW0L22b0.

* cited by examiner

*Primary Examiner* — Amy Sterling
(74) *Attorney, Agent, or Firm* — Daniel Boudwin; Global Intellectual Property Agency LLC

(57) ABSTRACT

A powered auger support device is provided having connection to a vehicle, a trailer hitch receiver on a vehicle, or the bed of a trailer, whereby a powered auger is slideably supported along an upright rail by way of a winch controlled by an operator. The device comprises a support structure having an upright rail, an auger support frame, and a pulley and winch system for raising and lowering the auger support frame. The auger support frame supports the handles of a stand-along auger and is pivotably supported along the rail, permitting the support frame to rotate with respect to the frame for placing the auger working end at different angles or in a horizontally stowed position. An embodiment of the upright rail contemplates a rotational hinge that places the auger support frame outside of the vehicle wheel tracks or outside of the bed of a trailer during use.

11 Claims, 10 Drawing Sheets

POWERED AUGER SUPPORT ASSEMBLY FOR A VEHICLE

CROSS REFERENCE TO RELATED APPLICATION

This application claims the benefit of U.S. Provisional Application No. 61/607,842 filed on Mar. 7, 2012, entitled "Adaptable Auger System." The above identified patent application is herein incorporated by reference in its entirety to provide continuity of disclosure.

BACKGROUND OF THE INVENTION

1. Field of the Invention

The present invention relates to augers, auger supports, and vehicle accessories. More specifically, the present invention pertains to a vehicle-mounted auger support that allows the auger to be controlled while being deployed in a drilling operation using a winch mechanism and an upright rail, stowed in a horizontal position by a pivotal attachment, and drill in locations outside of the track of the vehicle. The device is a support that is adapted for use with all terrain vehicles, trailers, and in connection with vehicle trailer hitches.

Augers are drilling devices used to drill downward into a substrate material to create a hole therein or opening therethrough. These devices include a helical screw blade that acts to break-up the substrate material and convey it along the length of the blade and out of the created hole. Rotation of the helical screw aces as a conveyor for loose material, which is drawn out of the hole in an excavating process, efficient creating a penetrating hole that is confined within the diameter of the given auger blade. These are commonly utilized devices that have served a useful tool across centuries. Common applications include digging vertical holes through earth for construction works, for post hole digging, for drilling through wood, and finally for creating defined holes in ice for ice fishing activities.

Modern augers are driven by a motive force such as an internal combustion engine or an electric motor, which drives the auger blade in a rotational direction that acts to convey material towards the proximal end of the auger screw. These devices can be quite heavy and cumbersome to handle individually, depending on the size of the auger screw and the intended application. They are particularly cumbersome if traveling considerable distances between uses, or when transporting the device to a desired work site. Along with transportation, actual handling of the device while operation requires physical strength and stability to control the powered auger while in a digging operation. The auger must be stabilized and its position must be controlled, whereafter there device may need to be lifted from a created hole thereafter.

These issues lead to real hardships for some individuals and for those requiring digging tools in remote areas. While in operation, a powered auger can pose a risk to the user if not properly controlled, because of its weight, power, and overall size. If the auger overpowers a user, the user may be at risk of injury. If the user becomes tired, he or she may limit the auger operation to shortened periods with frequent breaks, which can dramatically increase the amount of time required to complete a task. Still others may not be able to use the device at all without assistance, thereby preventing their use of the auger independently and in remote locations.

Of particular concern in the present disclosure is the use of an auger in remote environments such frozen lakes (ice fishing) and along property boundaries where one may be erecting a fence line. To increase the efficiency of the auger, to control its operation, and to facilitate its use in remote areas and by individuals of all type, it is desired to disclose a powered auger support device that is mountable to a vehicle and one that provides powered control over the operation of the auger during deployment. Specifically, a vehicle support frame having an upstanding rail, an auger support frame, and a crank or drive means for controlling the relative position of the auger support frame with respect to the upstanding rail is provided. The upstanding rail is pivotable to operate the auger outside of the vehicle tracks, while the auger support frame is pivotably attached for off-angle drilling and stowing the auger between uses. The connection between the upstanding rail and the vehicle is one that includes an all terrain vehicle attachment frame, a standing frame for a trailer bed, or a trailer hitch receiver frame, offering flexibility for the chosen deployment of the present invention.

2. Description of the Prior Art

Devices have been disclosed in the prior art that relate to auger support frames and vehicle mounts. These include devices that have been patented and published in patent application publications, and generally relate to different structures and supports that support a powered auger on different vehicle types. The present invention provides a structure that utilizes a winch or drive means to control the position of the auger, along with an architecture that allows flexibility with regard to auger deployment and storage. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 5,363,925 to Gallagher discloses a mobile drilling machine that is mounted to an all terrain vehicle along the rear luggage rack thereof. A support bearing pivotably supports a drill that supports an auger aligned therewith. The drill beam includes a base plate having a hydraulic cylinder and hydraulic motor, which is used to drive the auger rotation during a drilling operation. A drive chain and sprocket control the vertical positioning of the auger in relation to the drill beam, allowing the auger to drive into the earth during operation. The Gallagher device, while disclosing a similar device as the present invention, utilizes a hydraulic power means to drive the auger and the drive chain of the device. The present invention contemplates a pivotable auger support allows the auger to be positioned in either a horizontal or vertical position, while also providing a pivotable frame that allows the drilling to be offset from the vehicle. Finally, the present invention utilizes the support vehicle winch or a manually driven winch to control the vertical positioning of the auger with respect to its frame.

U.S. Pat. No. 5,836,402 to Jones discloses an auger holder designed to be equipped and attached to an all terrain vehicle. The Jones device comprises a first and second holder frame. The primary frame includes support members for the assembly and attachment to the vehicle, while the secondary frame is adjustably connected to the primary frame and supports the auger at desired angles relative to the ground, thereby permitting a vertical hole to be dug into sloping earth by angling the auger into a vertical position while the vehicle is position on the slope. The Jones device is ideal for post hole digging over uneven and sloping terrain. The elements of the Jones device, while of similar art, provide different functionality when compared to the present invention. The present invention provides a movable auger support, whereby the support is both pivotable and hingeable to allow the user to stow the assembly or drill outside of the vehicle tracks while in the field.

Another such device is U.S. Pat. No. 6,681,470 to Scott, which discloses a method of mounting an auger to a motor vehicle, whereby a mounting plate is slideably attached to a slide bearing assembly. The mounting plate supports the handles of an independent auger and allowing vertical movement of the auger while thereattached for drilling purposes. A swivel bearing assembly is further provided that allows the auger to be rotated within a plane parallel to the rear of the vehicle, whereby the angle of the auger can be directed against off angle ground surfaces or moved into a horizontal position for storage. Also described is an attached for the assembly to a tow hitch receiver. The present invention contemplates the rotational features of the Scott device, but further describes a vehicle winch or hand crank winch to raise and lower the attached auger while drilling. Also described by the present invention is a pivot joint that allows drilling outside of the vehicle tracks.

Finally U.S. Patent Application Publication No. 2010/0308093 to Johnson discloses an auger hauler that allows an auger to be removably supported by a vehicle within a frame. The frame includes a pair of opposing support arms that support an auger in a horizontal position between uses. The arms include U-bolt members that support the auger in an elevated position, whereby the auger can be quickly dispatched from the hauler and utilized in the field. The Johnson device provides an upstanding support that can support a stowed auger. It is not designed to support an operating auger, and does not facilitate drilling operations. The present invention provides a pivotable and rotatable support for an auger that can assist in drilling operations when attached to a vehicle, eliminating the need for a user to manually handle the auger while drilling holes in earth or ice.

The present invention provides an auger support device that is attachable to a vehicle for hands-free use of the auger while in the field. The device comprises an upstanding rail having a winch and pulley system for controlling the position of the auger while in operation along the vertical rail. An auger frame is provided for connection to specific styles of augers, while the upstanding rail connection to the vehicle may take on several forms, including an ATV frame connection, a trailer bed support, and a trailer hitch receiver connection. It is submitted that the present invention is substantially divergent in design elements from the prior art, and consequently it is clear that there is a need for an improvement to existing auger support devices for vehicles in the art. In this regard the instant invention substantially fulfills these needs.

SUMMARY OF THE INVENTION

In view of the foregoing disadvantages inherent in the known types of auger support devices now present in the prior art, the present invention provides a new assembly for controllably positioning a powered auger device when in operation or while stowed, wherein the same can be utilized for providing convenience for the user when supporting the auger from a vehicle and not physically handling the auger while in operation.

It is therefore an object of the present invention to provide a new and improved auger support device that has all of the advantages of the prior art and none of the disadvantages.

It is another object of the present invention to provide an auger support device that controllably supports a powered auger device from a vehicle, whereby the auger can be traveled over significant distances and utilized by a user without physically handling the auger device while in operation or when stowing the device.

Another object of the present invention is to provide an auger support device that offers users the flexibility of supporting a powered auger from a number of different vehicles, including all terrain vehicles, trailers, and vehicles having a trailer hitch receiver.

Yet another object of the present invention is to provide an auger support device that allows a user without the physical strength or without assistance to control an auger drilling operation while in the field, whereby the auger is operational and positionally controlled by the user without handling the auger.

Another object of the present invention is to provide an auger support device that offers users the ability to drill using an auger attached to a support frame, whereby the auger is sufficiently stable to drill through ice, sand, or soil.

Another object of the present invention is to provide an auger support device allows off-angle drilling and drilling outside of the tracts of the vehicle during deployment.

Another object of the present invention is to provide an auger support device rotatably supports an auger using a rotatable support frame along the upstanding rail, whereby the auger can be positioned at different drill angles and the auger can be stowed in a horizontal position when not in use.

Another object of the present invention is to provide an auger support device vertically controls the position of the powered auger using a winch and pulley mechanism, wherein the winch is manually driven by a user or controlled using a powered winch device.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
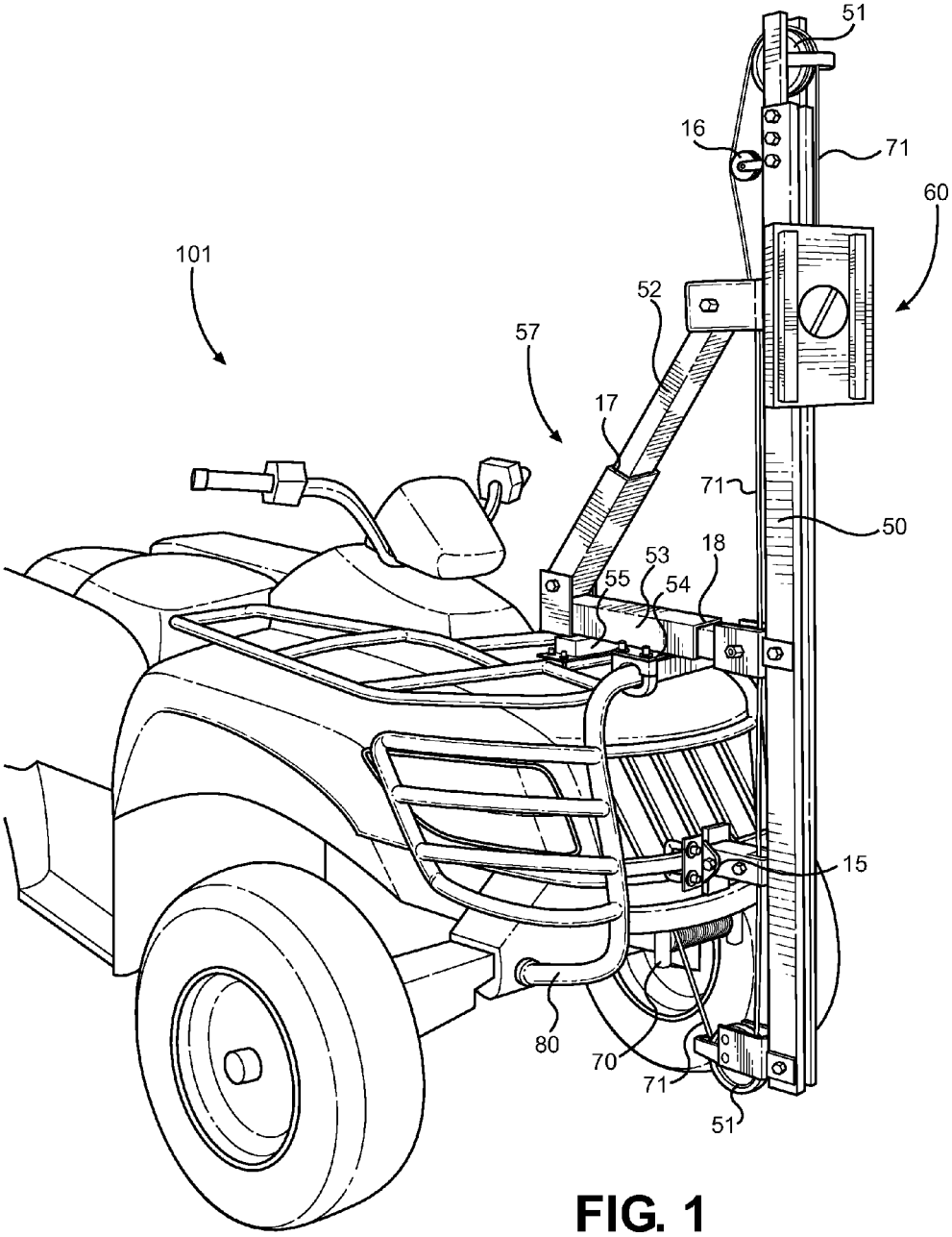
FIG. 1 shows a perspective view of a preferred embodiment of the present invention, wherein the assembly is supported by an all terrain vehicle frame along its forward end.

Reference is made herein to the attached drawings. Like reference numerals are used throughout the drawings to depict like or similar elements of the auger support device. For the purposes of presenting a brief and clear description of the present invention, the preferred embodiment will be discussed as used for supporting a powered auger from a vehicle for unassisted deployment in drilling operations by a single operator. The figures are intended for representative purposes only and should not be considered to be limiting in any respect.

Referring now to FIG. 1, there is shown a frontal perspective view of the preferred embodiment of the present auger support device, whereby a powered auger is adapted to be movably supported along a support frame and controlled by an operator on the vehicle. The device is a support assembly that holds a powered auger during drilling operations, while the operator can remain on the vehicle and operated the auger without physically handling the same during deployment. The frame is one that supports the weight of the auger device and the load imparted thereon during the drilling operation, where the auger drill drives into the earth and reactive loads are driven into the support device. The device transfers these operating loads into the vehicle itself by way of its multi-point connection, providing a stable connection for the auger during deployment and when stowed between uses.

Looking to FIG. 1, the preferred embodiment comprises an upstanding rail 50 that supports an auger support frame 60 therealong. The support frame 60 provides connection for auger-specific connections, which can vary depending on the type and style of the powered auger thereattached and desired by the operator for the given working environment. The frame 60 is supported by a cable 71 that is supported by a first and second pulley 51 at the ends of the upstanding rail 50. The cable 71 connects to the support frame 60 from its upper portion, extends upward and over an uppermost pulley 51, and downward along the rear of the upstanding rail 50 towards the lowermost pulley 51. The cable 71 then is wound and controlled by a powered winch 70 from the vehicle, which determines the cable 71 extended length, controlling the vertical positioning of the auger support frame 60 along the upstanding rail 50. The frame 60 and rail 50 are slideably connected to one another, whereby the weight of the supported auger and the frame 60 bias the frame 60 towards the upstanding rail 50 lower ends while the cable 71 extended length resists sliding motion.

The upstanding rail 50 allows the auger support frame to move vertically during operation, whereby an auger drill can descend into ice or earth to create holes therethrough, whereafter the auger device can be lifted from the hole by drawing the cable 71 onto the spool of the winch 70. A cable tensioning idler pulley 16 maintains tension on the cable during operation and prevents the cable from slacking as the auger descends into the ground. In a preferred embodiment, the rail 50 is supported by an all terrain vehicle 101 by way of a forward vehicle frame 80, such as the vehicle chassis, brush guard, or forward vehicle rack. The upstanding rail 50 preferably comprises a rear horizontal support member 53 extending perpendicularly from the frame mid-body, along with an angled support member 52 forming a triangular frame 57 with said horizontal support member 53 and extending angularly downward from the rail. The angled and horizontal support members connect at a rear junction to form their triangular configuration, while at least two attachment points are provided between the horizontal member 53 and the vehicle frame 80. The triangular configuration creates a stable structure for which the rail 50 to be supported, whereby loads are transmitted into the members 52, 53 during auger operation and during support thereof.

In an embodiment of the upstanding rail, more than one upstanding rail may be deployed. This configuration is useful for heavier and more powerful augers, which may require greater stability and greater structural support. The multiple rails would be position in parallel to one another and commonly support the auger support frame as it slides therealong, by way of the cable and winch system.

Figure 2:
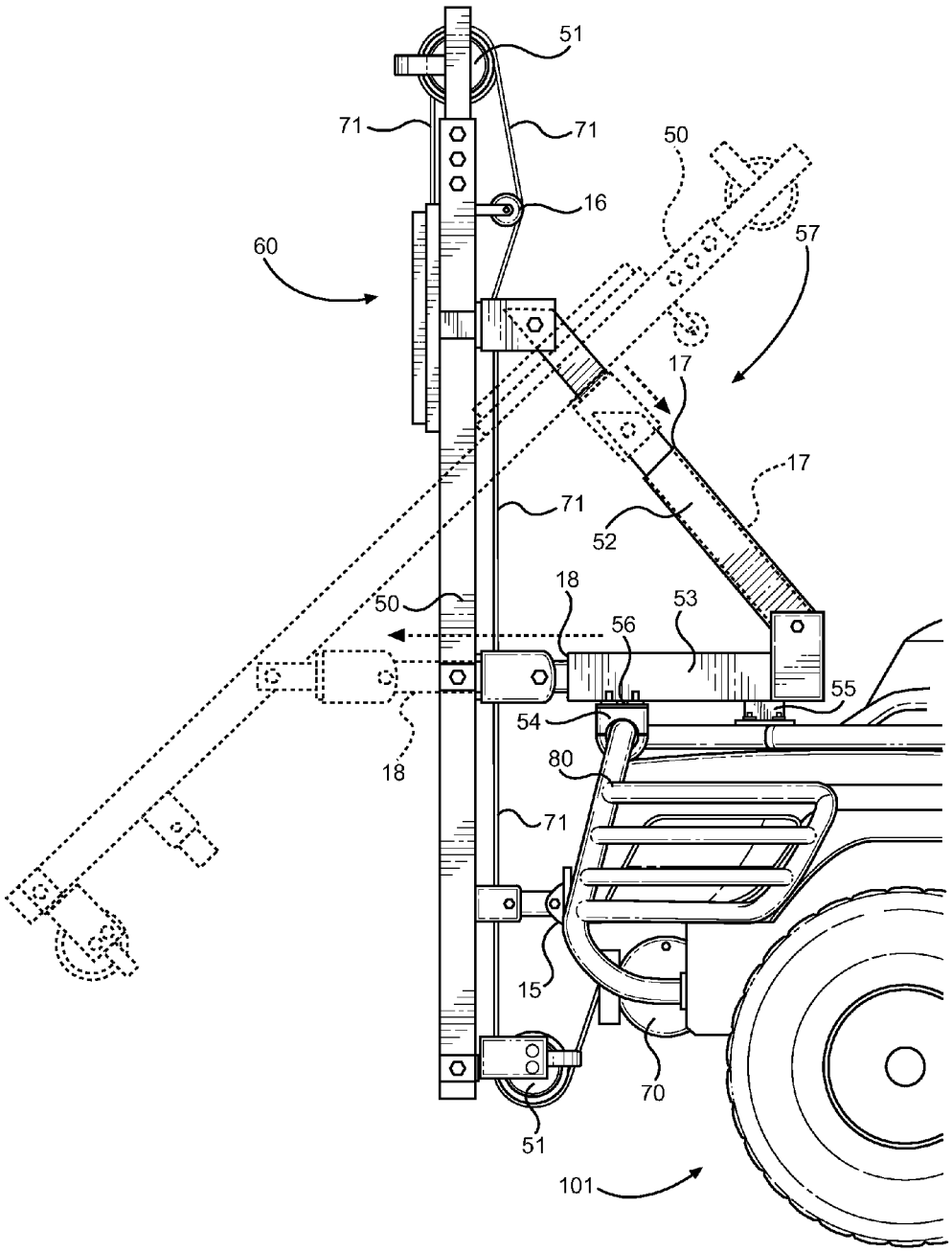
FIG. 2 shows a side view of the preferred embodiment of the present invention.
Figure 3:
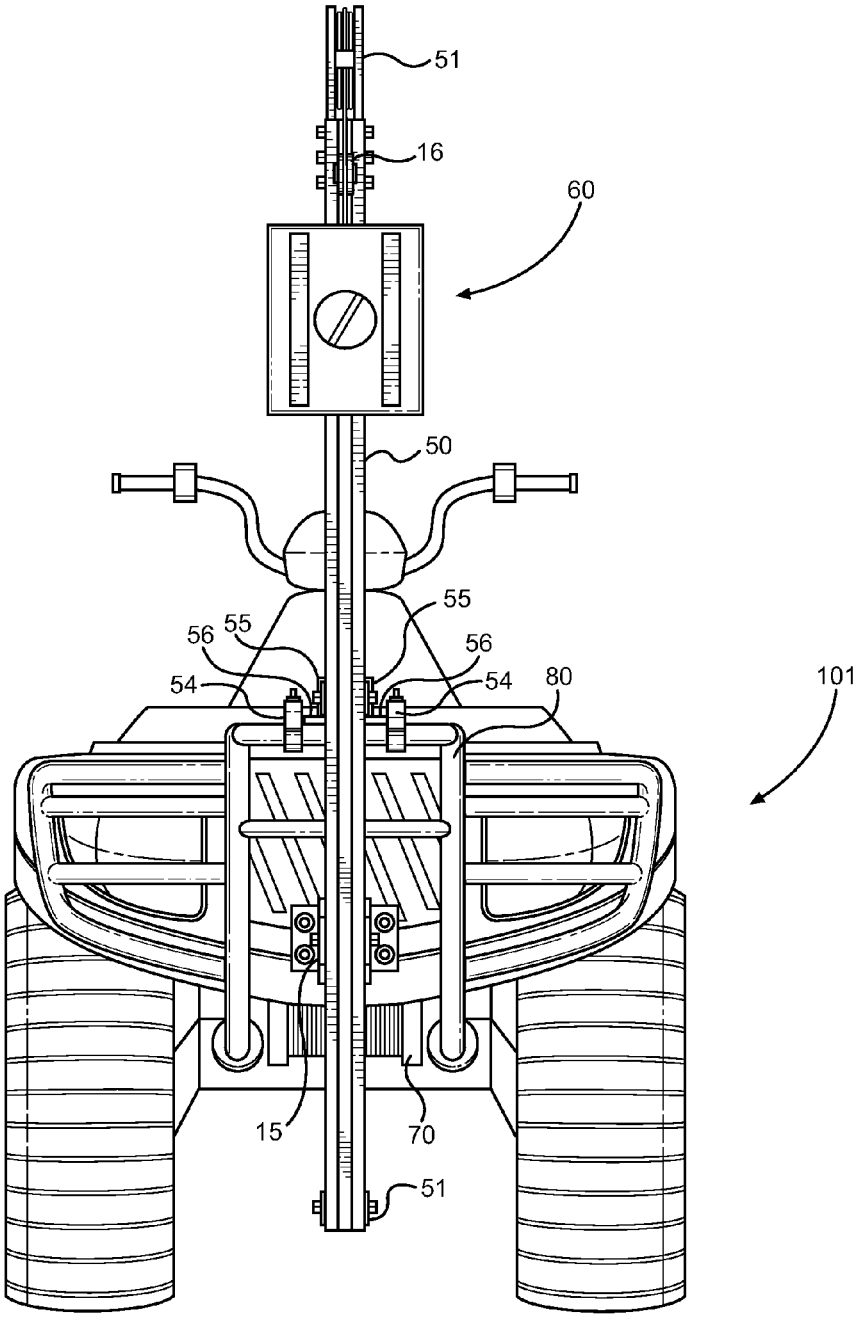
FIG. 3 shows a frontal view of the preferred embodiment of the present invention.

As seen in FIGS. 1 through 3, the horizontal member 53 secures to the vehicle frame 80 along a forward connection point 54 and a rearmost connection point 55. These two connections preferably comprise removable connectors between the frame 80 and the horizontal member 53 for releasably supporting the assembly as desired by the vehicle 101 owner. In one embodiment, the connection points comprise cross members 56 having a pair of U-bolts attached thereto, whereby the U-bolts surround the vehicle frame (e.g. an ATV forward rack or brush guard) and secure the member 53 thereto. The U-bolts are U-shaped members having threaded connections to the cross member, allowing the user to secure the cross member 56 and thus the horizontal member 53 in a static position to the frame 80. The cross member 56 is preferably welded or otherwise permanently connected to the horizontal member 53.

The triangular frame 57, comprising of the horizontal 53 and angled 52 members, provides support for the upstanding rail 50 along its mid-body. The horizontal member 53 further comprises a telescoping structure 18, whereby its length can be adjusted to pivot the upstanding rail 50 inwards and outwards. Similarly, the angled member 52 includes a telescoping structure 17 to offer adjustability of this member and positioning of the upstanding rail 50 as necessary. A lower securement for the upstanding rail is provided along the lower portion of the rail 50, whereby a lower coupling 15 secures the rail 50 below the triangular frame 57 to prevent rocking of the rail 50 and overstressing the triangularly frame 57 connections. This lower coupling 15 comprises a similar U-bolt structure for attachment to a lower vehicle frame member, or further a direct connection to the vehicle chassis or to a trailer hitch receiver. Using a U-bolt, the attachment point 15 can secure to an all terrain vehicle brush guard frame 80 and be readily removed when desired by the operator. If securing to the vehicle chassis, a base plate and fasteners may be required to secure the rail 50. Finally, if a trailer hitch receiver is present, a corresponding trailer hitch member can be inserted thereinto a pinned into position. Together, the upper triangular frame 57 and the lowermost coupling 15 provide three secure mounting locations for the upstanding rail 50 along the forward portion of an all terrain vehicle 101.

Figure 4:
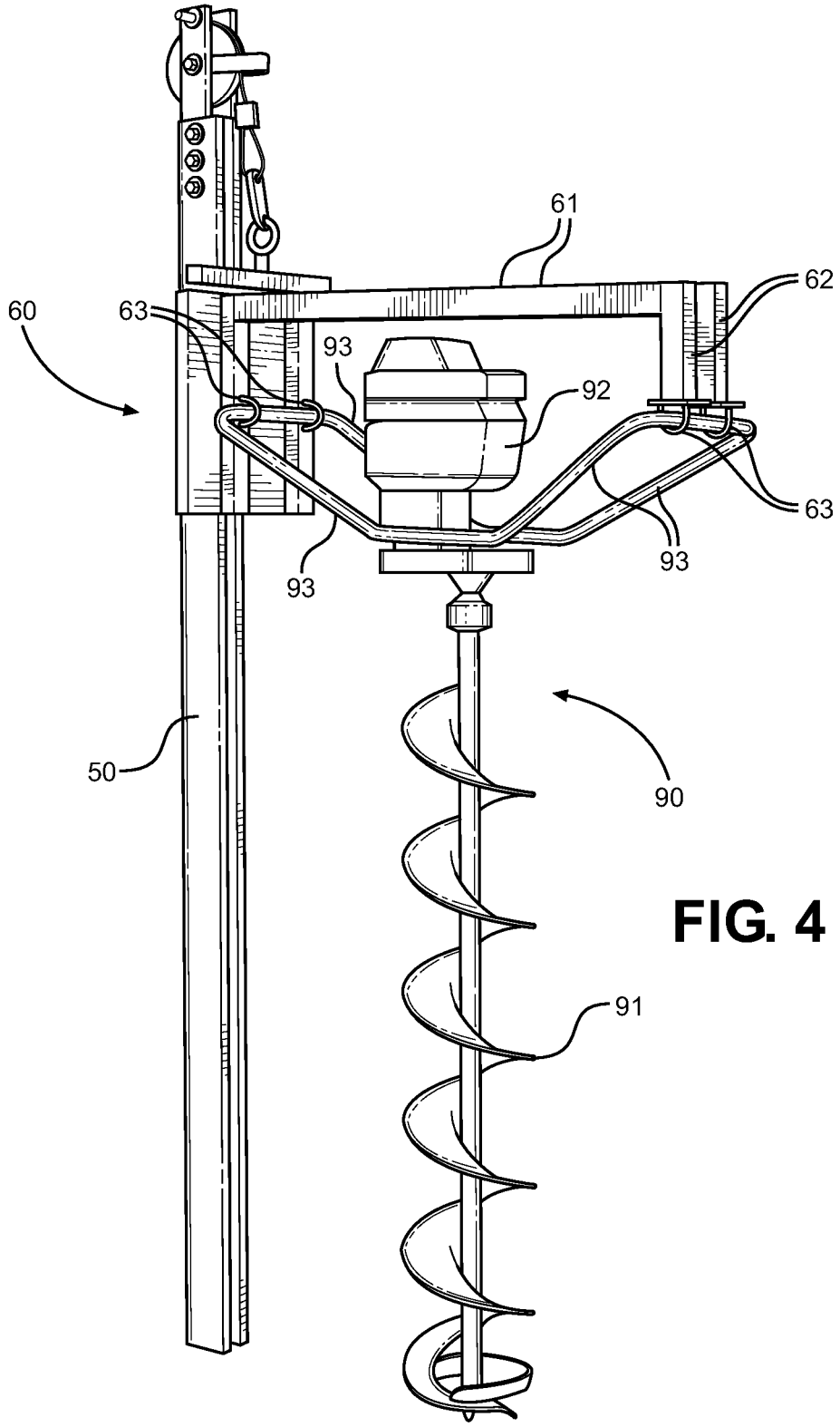
FIG. 4 shows a perspective view of an embodiment of the auger support frame in operation supporting a powered auger device.
Figure 5:
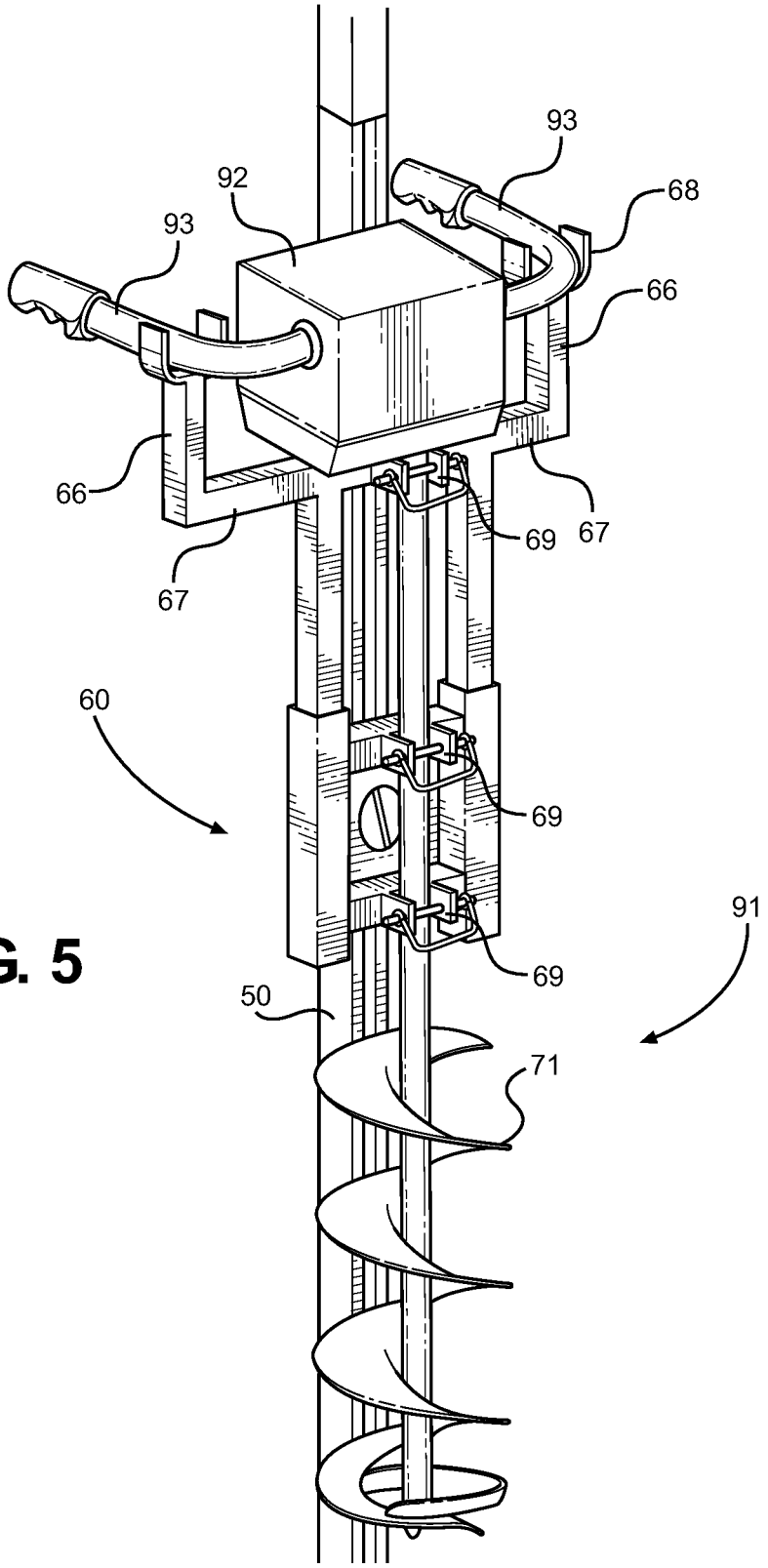
FIG. 5 shows a perspective view of another embodiment of the auger support frame in operation supporting a powered auger device.

Referring now to FIGS. 4 and 5, there are shown a perspective view of the auger support frame 60 supporting a particularly style of powered auger 90 having extended handles otherwise handled by an operator during operation. The auger support frame 60 is one that is adapted to support otherwise manually operated augers, whereby the auger is powered by a gas or electric drive and includes user handles for manually operation. In another embodiment, an auger that is designed for use only with the support frame 60 may be deployed in conjunction with the present invention. It is not desired to limit or describe the particular structural elements of the auger beyond that of being powered and having an elongated auger drill 91 extending therefrom for hole digging. The present invention pertains to a vehicle support assembly that is well adapted for supporting powered augers of any type, wherein the auger position can be carefully controlled for use in the field, and further the auger can be traveled across distances in connection with a vehicle without resorting to physically handling the auger or using ad hoc attachment means such as attachment straps or tie-downs.

Referring to FIG. 4, there is shown an auger having a pair of opposing and upwardly extending handles 93 that are supported by the present support frame 60 and extensions therefrom. In this embodiment, a first and second support arm extension 61 extends outward from the frame 60, terminating at a connection point with downward directed arms 63 that connect to the auger outboard handles 93 by way of removable connectors. The removable connectors are preferably U-bolts 63 to allow the handle 93 to be surrounded and supported. The inboard handle 93 of the auger is supported against the frame 60 by way of a second pair of U-bolts 63. In this way, the handles 93 are removably supported by the frame and in a level configuration. The gas powered or electric motor 92 of the auger is positioned below the above support arm extensions 61, while the auger turnscrew blade 91 extends downward from the motor 92 along the upstanding rail 50. The position of the auger support frame 60 is dictated by the winch and cable support system, which is operated by the user to lower and raise the drill 91 into and from the ground surface therebelow.

Referring now to FIG. 5, there is shown a second embodiment of the powered auger 90 and the support therefor extending from the auger support frame 60. In this embodiment, the auger 90 comprises an electric or gas powered motor surrounded by two upright handles 93 that include horizontal handle extensions. To support this type of auger handle 93, a pair of support arms 93 extend outwardly 67 and upwardly 66 from the frame 60, terminating at U-shaped support for the handles 93. The drill 91 of the auger is supported through receiving clips to retain the drill 91 position while in operation, while the support arms 93 secure the handles of the auger 90 and prevent dislodgment or relative movement of the auger with respect to the support frame 60.

Overall, the present invention provides a powered auger support frame 60 that can be adapted to accept handled auger devices, or alternatively augers that are designed to be supported by a frame rather than by an operator directly. The elements extending from the auger support frame 60 may vary in design detail depending on the style, brand, and elements of the particular auger. The two embodiments show in FIGS. 4 and 5 are exemplary embodiments contemplated by the present invention.

Figure 6:
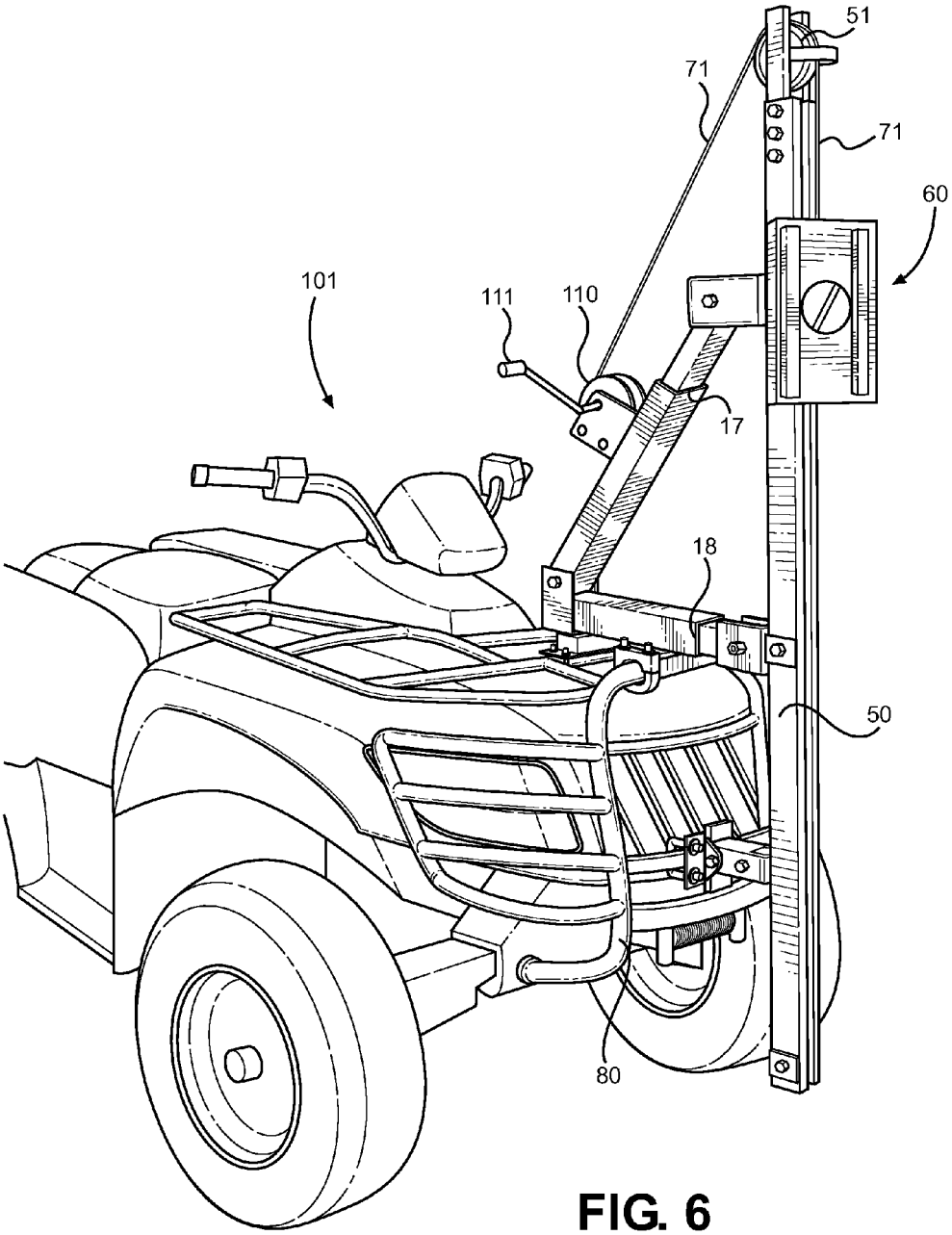
FIG. 6 shows a perspective view of an embodiment of the present invention, wherein the winch assembly for controlling the auger support frame is a hand-driven winch for receiving manual input from an operator.

Turning to FIG. 6, there is shown an embodiment of the auger support frame control mechanism of the present invention. Notably, the cable 71 and winch system is provided as one requiring manual-input from the operator, as opposed to a powered winch from the attached vehicle. In this embodiment, a hand-driven winch 110 is provided having a hand crank and a spool for winding and unwinding the cable 71 therefrom. This embodiment does not rely on electrical input from the vehicle to operate, and is an embodiment that is of simpler and less expensive design. The winch 110 is preferably positioned on the triangular frame 57 of the assembly for rigid support during operation. The winch 110 receives considerable load from the cable 71 as it tensions and supports the auger support frame 60 along the upstanding rail 50. The cable 71 extends from the winch 110 spool, over an uppermost pulley 51, and downward to connect to the auger support frame 60.

Figure 7:
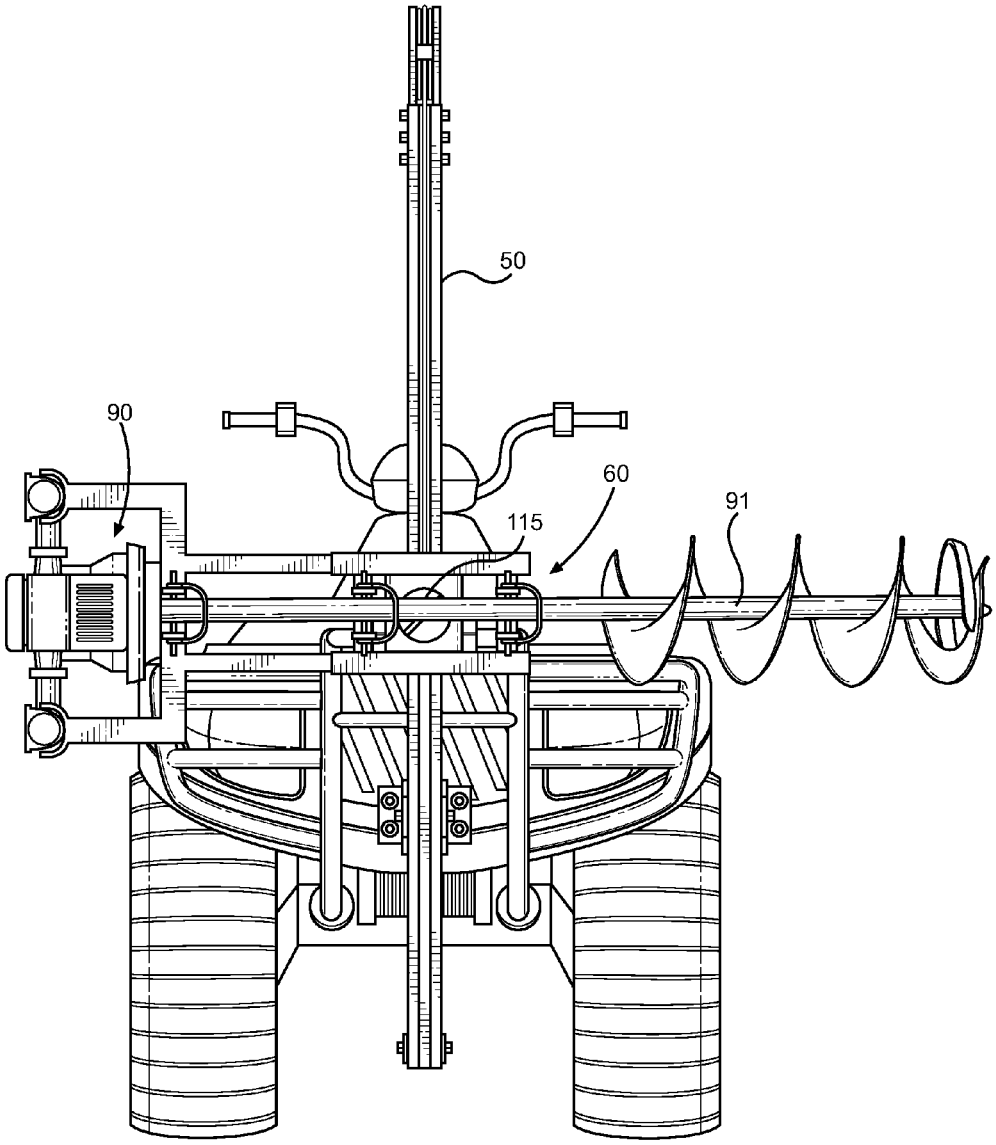
FIG. 7 shows a frontal view of the rotatable connection between the upstanding rail and auger support frame, wherein the powered auger device is supported in a horizontal, stowed configuration along the forward end of an all terrain vehicle.

Referring now to FIG. 7, there is shown a frontal view of the present invention deployed on an all terrain vehicle and supporting an attached auger 90 in a horizontal position. The preferred connection between the auger support frame 60 and the upstanding rail 50 is a slideable connection, where this connection can also allow controlled pivoting of the frame 60 with respect to the rail 50 for off-camber drilling and for rotating the auger 90 into a stowed position (horizontal) when traveling over uneven terrain. While transporting the auger 90, the operator may be required to travel significant distances over undeveloped terrain. The ability to rotate the attached auger 90 such that its drill 91 is positioned above the ground surface is critical to ensuring adequate frontal ground clearance and approach angles for the front of the vehicle. If the auger 90 is kept vertical, even with the frame 60 in its highest position, the length of the auger blade 91 may compromise frontal clearance and approach angles between an upcoming hill and the front wheels of the vehicle. Therefore, a pivot joint 115 is disclosed, wherein the joint 115 structure slides within the rail 50 and rotatably attaches to the frame 60 to allow pivoting of the frame 60 and thus the attached auger while traveling with or during operation of the auger. The pivot joint 115 is preferably a locking pin joint, detented rotational joint, or similar mechanical assembly that allows rotation of the frame 60 and locking thereof in a desired position during operation. The ability to lock the pivot joint 115 ensures the auger 90 will not freely rotate during transport or during drilling operations.

Figure 8:
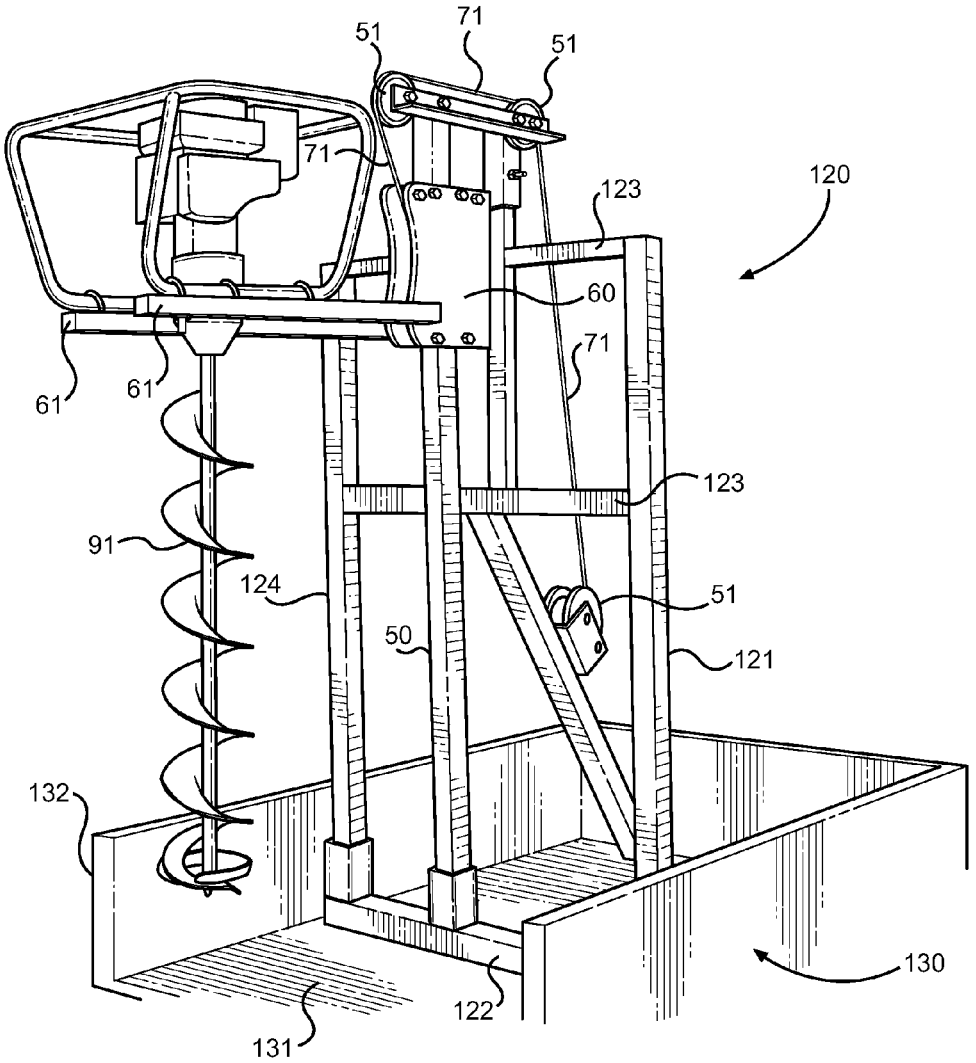
FIG. 8 shows an embodiment of the present invention being deployed from the bed of a trailer.

Referring now to FIG. 8, yet another embodiment of the present invention is disclosed. In this embodiment, the upstanding rail 50 is supported by an upstanding frame 120 that is supported within the bed 131 of a vehicle trailer 130 or bed of a pickup truck. The upstanding frame 120 comprises a plurality of vertical members 121, a base 122, and intermediate horizontal members 123 to provide a sturdy support of the upstanding rail 50 supporting the auger. This embodiment is contemplated for heavier and larger augers, where the auger drill 91 is positioned over the end 132 of the trailer 130 and lowered into the ground behind the trailer 130. The auger is supported by the auger support frame 60, which slideably connects to the upstanding rail 50 and is positionally controlled by the cable 71 and pulley 51 system. This embodiment may be driven by a hand crank or powered winch, depending on the design of the unit and the size of the auger thereattached. The upstanding frame 120 is supported by its base 122, which is fastened or otherwise securely attached to the trailer bed surface 131. Also visualized in FIG. 8 is an embodiment of the auger support arms 61, which support the auger from below and extend from the auger support frame 60.

Figure 9:
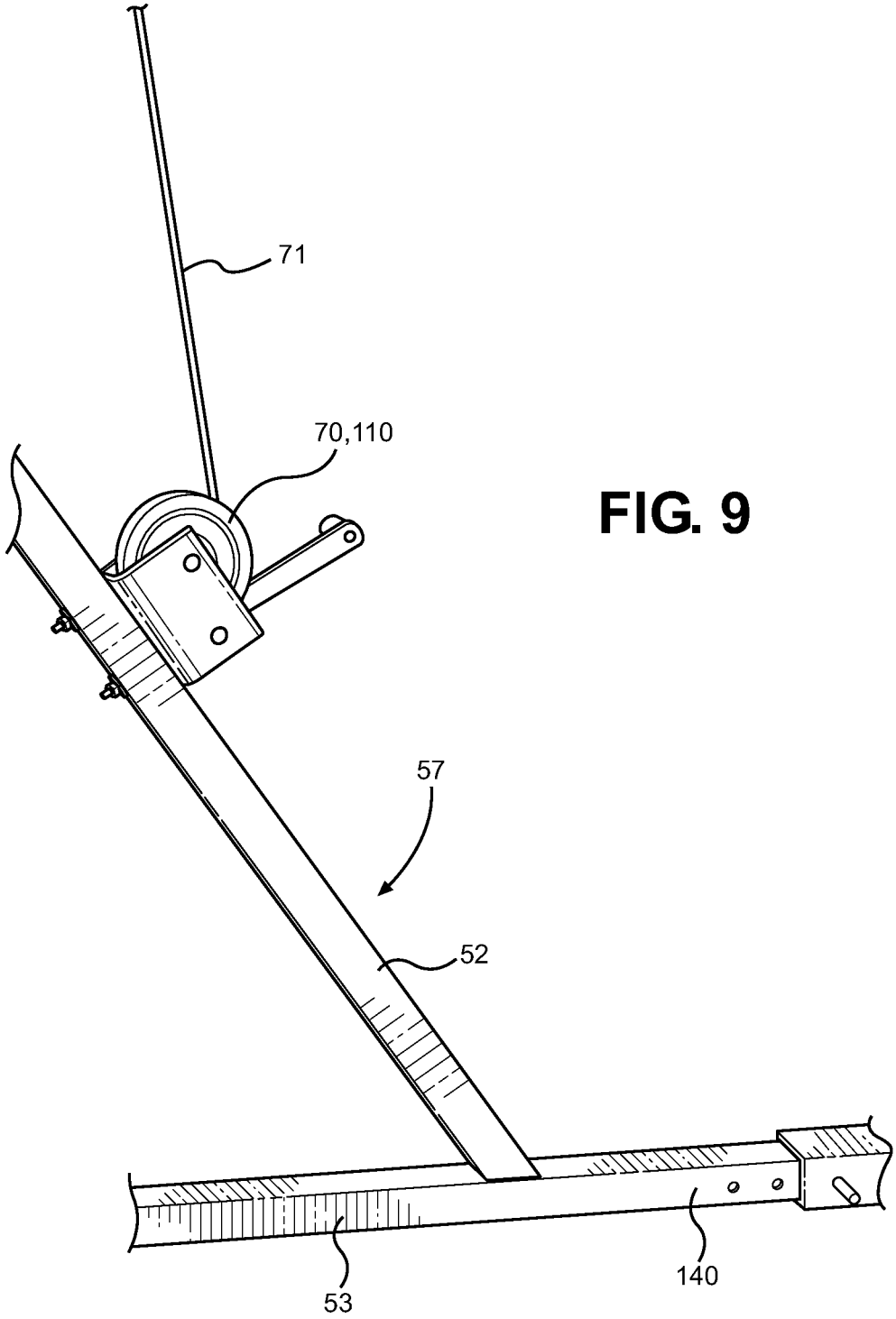
FIG. 9 shows an embodiment of the present invention being deployed from a trailer hitch receiver attached to the rear of a vehicle.

Referring now to FIG. 9, there is shown an embodiment of the rear triangular frame 57 of the upstanding rail connected to a trailer hitch receivers 141, whereby the auger support device is supported by a vehicle having a trailer hitch receiver. An elongated hitch receiver member 140 extends from the triangular frame 57 to engage the hitch receiver 141 and lock that assembly in place using a pin lock joint. The horizontal 53 and angular 52 members support the assembly, while an embodiment of the winch 70, 110 and cable 71 system is deployed. This embodiment contemplates the auger support device being deployed on a pickup truck or similar vehicle having a rear hitch.

Figure 10:
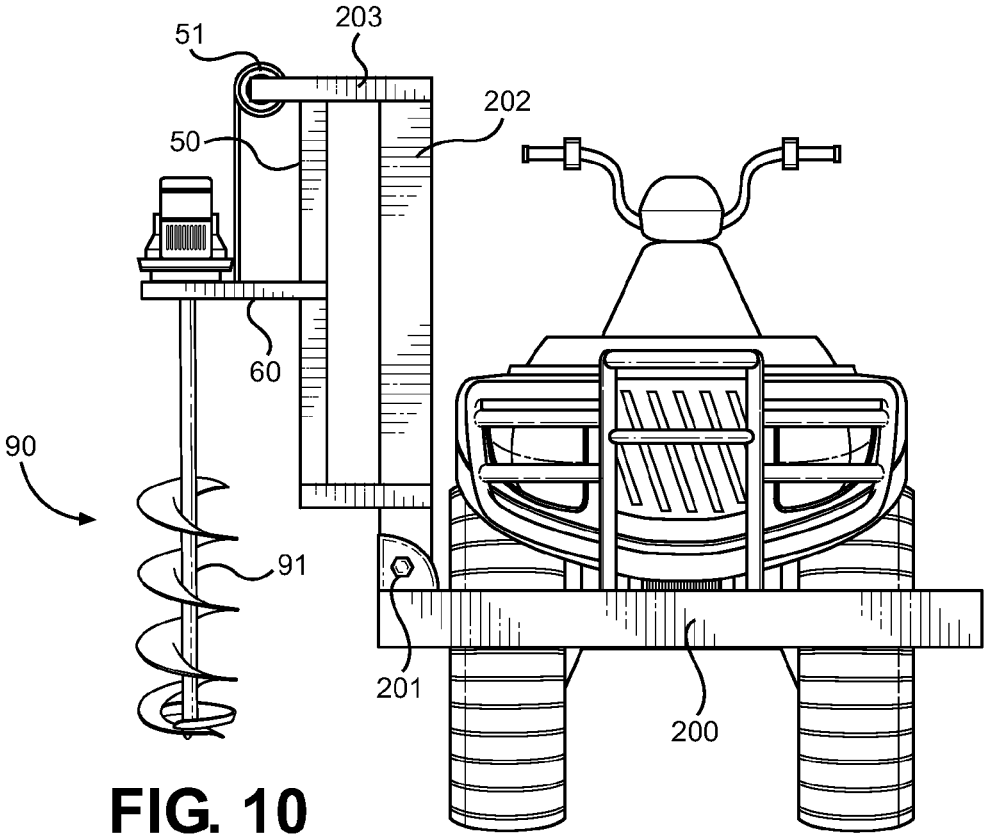
FIG. 10 shows an embodiment of the present invention, wherein the upstanding rail is rotatably supported by a support frame for drilling outside of the vehicle tracks.
Figure 11:
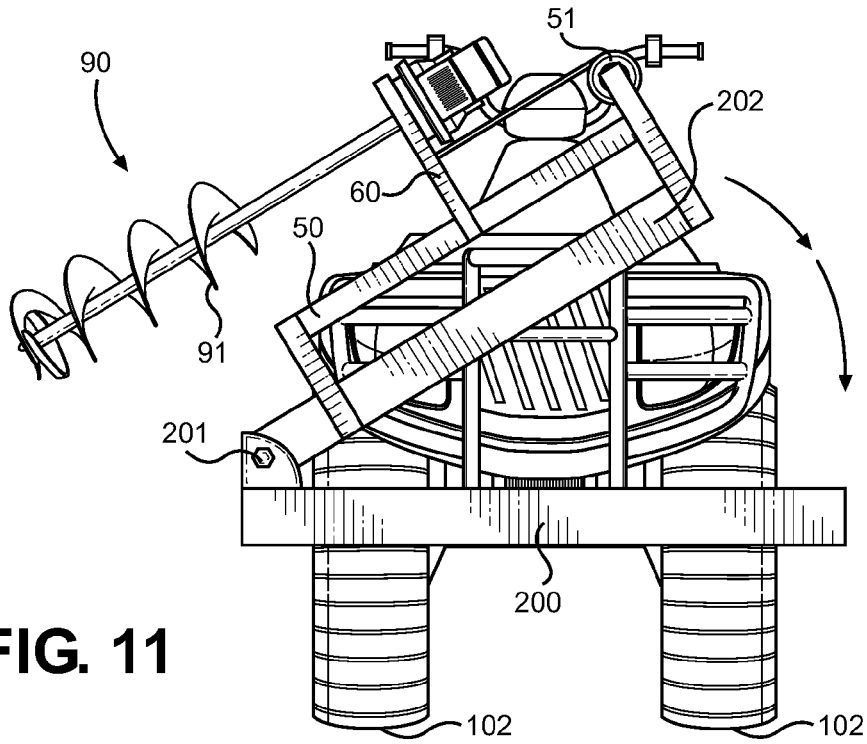
FIG. 11 shows the upstanding rail is rotatably supported and transitioning between a horizontal and vertical position before engaging in drilling operations outside of the vehicle tracks.

Referring finally to FIGS. 10 and 11, there is shown an embodiment of the present auger support device, wherein the upstanding rail 50, auger support frame 60, and attached auger 90 are rotatably supported by a pivot joint 201 between a horizontal frame 200 and an articulating frame 202. The horizontal frame 200 attaches to the vehicle and provides a horizontal plane upon which the articulating frame 202 to pivot 201 therefrom between a horizontal and vertical position. The articulating frame 202 supports the upstanding rail 50, auger 90, auger support frame 60, and cable and pulley 51 system. When in a horizontal configuration, the auger 90 is positioned horizontally and in a stowed position for transport. When the articulating frame 202 is pivoted into a vertical position, the auger 90 is position such that its drill 91 is outside of the wheel tracks 102 of the vehicle and the drill 91 is in a vertical position. This embodiment adds an additional layer that permits the formally disclosed assembly to be pivoted between a stowed and working position using two additional frame members 200, 202 and a pivot joint 201.

It can be difficult for anyone to drill holes into the ground or through ice, independent of the individual's strength or stature. When operating a powered auger, operators can easily injure themselves if adequate precautions are not taken and if careful control of the auger is not adhered to. The weight, power, and overall size of most powered augers can overtake an unassuming operator or one who is not paying full attention to the operation. If the auger does overpower an operator, the operator is prone to injury or the tool itself may be damaged and require repair. These situations can be exacerbated if the operator is conducting the operation alone and in a remote location (i.e. distant field, on an ice-covered lake, etc). Even if the operator maintains control and vigilance over the auger, the device may weaken the operator and make break periods necessary. This can slow the drilling process and the overall task, making the user exposed to the elements longer than necessary or delay the intended project task (e.g. post erecting, ice fishing, etc).

To dispose of these issues in the art of auger operation in remote locations and by operators that may be uncomfortable physically handling the device independently, the present invention is provided for supporting a powered auger from a vehicle and independent of operator contact. The device is a support assembly that secures to a vehicle, a trailer bed, or a toe hitch receiver from a lead vehicle. The assembly supports a powered auger that is adapted to be otherwise physically wielded, or alternatively supports a specifically designed auger for use only with support structure (i.e. not operator handles or higher powered). An upstanding rail raises and lowers the auger by way of a slideable and pivotable support frame, whereby a winch and cable system controls the positioning of the frame. Several embodiments are contemplated, including an embodiment that contemplates drilling outside of the vehicle tracks of the support vehicle by way of a rotatable upstanding rail.

It is not desired to limit the application of the present structure to a given vehicle type. The vehicle may comprise an all terrain vehicle, a full size truck, or a non-powered vehicle such as a sled or towed trailer. The present assembly is deployable from a flat surface, from connection points on the vehicle, or from a trailer hitch receiver. It is desired that the present invention may be deployed in any number of vehicle types, whereby its winch and pulley system allows for controlled operation of the auger as it is in operation.

Overall, the device provides an operator with a means to transport and operate a powered auger without regard to his or her physical capacity. The device is ideal for ice fisherman, land workers and construction workers, and for homeowners with extended property.

Along with the disclosed structure of the auger support, its operation is desired to be controlled directly from the attached vehicle or from a distance therefrom. Specifically, if a motorized winch is deployed, a user can operate the winch via the vehicle controls. Alternatively, a remote control system may be implanted for operating the device outside of the vehicle. Finally, a manually powered winch can be deployed that does not rely on electrical input. To operate the electrically driven winch, a master switch or key may be deployed to prevent unauthorized usage while in transport or use by unauthorized users (e.g. small children, etc.).

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A powered auger support assembly for a vehicle, comprising:

an upstanding rail slideably supporting an auger support frame;

a triangular frame comprised of a horizontal and angled support member connected to said upstanding frame;

said triangular frame supportable by a vehicle;

at least one pulley supporting a cable;

said cable extending from a winch to said pulley and connecting to said auger support frame;

said auger support frame supporting a powered auger device;

a lower vehicle coupling below said triangular frame on said upstanding rail, said lower vehicle coupling securable to said vehicle for added structural support.

2. The device of claim 1, wherein said auger support frame is rotatably supported by said upstanding rail to rotate said supported powered auger device.

3. The device of claim 2, wherein said rotatably support further comprises a lock to secure said auger support frame in a desired orientation with respect to said upstanding rail.

4. The device of claim 1, wherein said winch further comprises a powered winch and spool.

5. The device of claim 1, wherein said winch further comprises a manual winch having a crank and spool.

6. The device of claim 1, wherein said triangular frame secures to an all terrain vehicle frame by way of removably attached U-bolt members.

7. The device of claim 1, wherein said triangular frame secures to a trailer hitch receiver using an elongated hitch receiver member.

8. The device of claim 1, wherein:

said triangular frame is supported by an upstanding frame having vertical members, a base, and intermediate horizontal members;

said base supported within a trailer bed.

9. The device of claim 1, wherein said horizontal support member of said triangular frame is length adjustable to adjust said upstanding rail orientation.

10. The device of claim 1, wherein said angled support member of said triangular frame is length adjustable to adjust said upstanding rail orientation.

11. The device of claim 1, further comprising cable tensioner pulley for maintaining tension in said cable.

* * * * *